US009731300B2

(12) United States Patent
Königsson

(10) Patent No.: US 9,731,300 B2
(45) Date of Patent: Aug. 15, 2017

(54) CENTRIFUGAL SEPARATOR WITH SLUDGE SPACE PLATES

(71) Applicant: ALFA LAVAL CORPORATE AB, Lund (SE)

(72) Inventor: Staffan Königsson, Tumba (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/441,497

(22) PCT Filed: Nov. 7, 2013

(86) PCT No.: PCT/EP2013/073285

§ 371 (c)(1),
(2) Date: May 7, 2015

(87) PCT Pub. No.: WO2014/072417

PCT Pub. Date: May 15, 2014

(65) Prior Publication Data

US 2015/0283558 A1 Oct. 8, 2015

(30) Foreign Application Priority Data

Nov. 8, 2012 (EP) ..... 12191740

(51) Int. Cl.
*B04B 1/08* (2006.01)
*B04B 7/14* (2006.01)
*B04B 1/04* (2006.01)

(52) U.S. Cl.
CPC ..... *B04B 1/08* (2013.01); *B04B 1/04* (2013.01); *B04B 7/14* (2013.01)

(58) Field of Classification Search
CPC ..... B04B 1/08; B04B 7/14; B04B 1/04
(Continued)

(56) References Cited

U.S. PATENT DOCUMENTS 793,759 A * 7/1905 Anker-Holte ..... B04B 1/08 494/64
1,548,308 A * 8/1925 Hackett ..... B04B 9/14 494/37

(Continued)

FOREIGN PATENT DOCUMENTS

CN 1035962 A 10/1989
DE 1178014 B 9/1964

(Continued)

*Primary Examiner* — Charles Cooley
(74) *Attorney, Agent, or Firm* — Birch, Stewart, Kolasch & Birch, LLP

(57) ABSTRACT

A centrifugal separator for separating a fluid mixture into components includes a rotor which forms within itself a separation space delimited by a rotor wall, and includes a set of separation plates defining separation passages there between. An inlet is arranged for supply of a fluid mixture to be separated and a first outlet is arranged for a separated lighter first component of the fluid mixture. A sludge space is being defined as an annular portion of the separation space radially outside the separation plates. A second outlet is arranged for discharge of a separated denser second component of the fluid mixture extending from the radially outer portion of the sludge space. A plurality of sludge space plates, which sludge space plates are separate components from the separation plates, is arranged in the sludge space, extending outwardly and in an annular direction with respect to the rotational axis, while forming a gap between the sludge space plates and the rotor wall.

13 Claims, 3 Drawing Sheets

(58) Field of Classification Search
USPC ..... 494/64, 67–73
See application file for complete search history.

(56) References Cited

U.S. PATENT DOCUMENTS

| | | | | | |
|---|---|---|---|---|---|
| 2,261,724 | A * | 11/1941 | Holm | C10G 73/28 | 196/46 |
| 2,599,619 | A * | 6/1952 | Eckers | B04B 1/00 | 127/67 |
| 2,622,796 | A * | 12/1952 | Steinacker | B04B 5/06 | 494/10 |
| 2,715,994 | A * | 8/1955 | Steinacker | B04B 5/06 | 494/22 |
| 3,117,928 | A * | 1/1964 | Thylefors | B04B 1/08 | 494/27 |
| 3,328,282 | A * | 6/1967 | Keith, Jr. | B04B 1/08 | 208/28 |
| 3,529,767 | A * | 9/1970 | Keith, Jr. | B04B 1/08 | 494/27 |
| 4,701,158 | A * | 10/1987 | Inge | B04B 1/08 | 494/74 |
| 4,721,505 | A * | 1/1988 | Inge | B04B 1/08 | 494/74 |
| 5,362,292 | A * | 11/1994 | Borgstrom | B04B 1/08 | 494/74 |
| 5,676,631 | A | 10/1997 | Kunz et al. | | |
| 6,533,713 | B1 * | 3/2003 | Borgstrom | B04B 11/06 | 494/66 |
| 7,410,457 | B2 * | 8/2008 | Heinrich | B04B 1/08 | 494/70 |
| 7,537,559 | B2 * | 5/2009 | Wieking | B04B 1/08 | 494/70 |
| 2011/0124481 | A1 | 5/2011 | Karlsson | | |
| 2012/0040816 | A1 | 2/2012 | Thorwid et al. | | |
| 2015/0126353 | A1 * | 5/2015 | Hagqvist | B04B 7/14 | 494/72 |
| 2015/0283558 | A1 * | 10/2015 | Konigsson | B04B 7/14 | 494/74 |

FOREIGN PATENT DOCUMENTS

| | | | |
|---|---|---|---|
| DE | 29 41 350 | A1 | 4/1981 |
| GB | 380415 | A | 9/1932 |
| GB | 919958 | | 2/1963 |
| GB | 1039031 | A | 8/1966 |
| JP | 56-51253 | A | 5/1981 |
| JP | 2011-520599 | A | 7/2011 |
| JP | 2012-239944 | A | 12/2012 |
| JP | 2014-533603 | A | 12/2014 |
| JP | 2015-515296 | A | 6/2015 |
| SE | 186 436 | | 11/1963 |
| WO | WO 2013/079194 | A2 | 6/2013 |
| WO | WO 2013/171160 | A1 | 11/2013 |

* cited by examiner

CENTRIFUGAL SEPARATOR WITH SLUDGE SPACE PLATES

TECHNICAL FIELD

The present invention relates generally to a centrifugal separator for separating a fluid mixture into components, in particular to a centrifugal separator comprising a rotor forming a separation space with a set of separation plates defining separation passages there between.

BACKGROUND

SE186436 shows a centrifugal separator having a stack of frustoconical separation discs wherein one disc forms an annular disc portion extending into the sludge space of the separation space. This annular disc portion is used to divide the disc stack into a first section where the cleaning of the light phase is optimised (purifier mode of operation) and a second section where the cleaning of the heavy phase is optimised (concentrator mode of operation).

SUMMARY

It is an object of the invention to improve the separation efficiency of the centrifugal separator as initially defined. In particular it is an object to reduce the risk of separated particles being recirculated into the separating passages between the separation plates.

Thus the present invention relates to a centrifugal separator for separating a fluid mixture into components, comprising a frame and a rotor which is rotatably supported in the frame around a rotational axis. The rotor forms within itself a separation space delimited by a rotor wall, and comprises a set of separation plates defining separation passages there between. The separation plates may be frustoconical discs or axial discs providing separation surfaces having an inclination with respect to a radial direction. The centrifugal separator further comprises an inlet extending into the rotor for supply of a fluid mixture to be separated in the separation space and a first outlet for a separated lighter first component of the fluid mixture extending from a radially inner portion of the separation space. This lighter first component of the fluid mixture may be a lighter liquid component, such as oil. A sludge space is being defined as an annular portion of the separation space radially outside the separation plates. The centrifugal separator further comprises a second outlet for discharge of a separated denser second component of the fluid mixture, such as sludge (comprising denser solid particulate matter), extending from the radially outer portion of the sludge space. A plurality of sludge space plates is arranged in the sludge space, extending outwardly and in an annular direction with respect to the rotational axis. The sludge space plates are separate components from the separation plates. A gap is formed between the sludge space plates and the rotor wall to allow sludge to pass between the sludge space plates and the rotor wall during discharge.

An effect of this is that currents or turbulence in the separation space radially outside the separation plates may be reduced. Such currents having an axial flow component may have the undesired effect to bring along particles already separated from a liquid mixture such that they are reintroduced into the separation passages between the separation plates. Due to the sludge space plates the risk of separated particles being recirculated into the separating passages of the disc package may thus be reduced and the separation efficiency of the centrifugal separator increased. Since the sludge space plates are separate components from the separation plates the shaping, size and distribution of the sludge space plates may be varied independently of the selection of separation plates (such as number, size, axial/frustoconical type etc.).

The sludge space plates may be in the form of annular discs enclosing the separation plates. The sludge space plates may extend in a direction perpendicular to the rotational axis. Thus the sludge space plates may act to define a flow zone radially outside the separation plates without acting as a separation surface.

The sludge space plates may be configured such that to provide a gap between the sludge space plates and the rotor wall. The gap between the sludge space plates and the rotor wall may be substantially constant and preferably at least 3 mm, more preferably at least 5 mm. Thus the gap is large enough to allow sludge to pass between the sludge space plates and the rotor wall during discharge.

A gap may be formed between the separation plates and the sludge space plates, and the gap between the separation plates and the sludge space plates may preferably be at least 3 mm. Thus the fluid mixture to be separated may be distributed over the separation passages of the separation plates. In particular if the separation plates are in the form of frustoconical discs provided with cut-outs in the form of slits to distribute the flow of fluid to be separated through and over the disc stack, which slits are cut-outs that are open towards the outer radius of the separation disc, this gap may reduce pressure drop over the disc stack. Alternatively, the gap between the separation plates and the sludge space plates may be minimised.

The sludge space plates may be arranged at a mutual distance which is larger than the distance between the separation plates defining separation passages there between. The mutual distance between the sludge space plates may be in the range of 2-40 mm, preferably in the range of 5-20 mm, more preferably of about 10 mm. The number of sludge space plates may be in the range of 5-30, preferably in the range of 10-20. Thus the number and distribution of sludge space plates may be particularly efficient in breaking flow patterns and at the same time provide enough space to avoid sludge collecting and not detaching at discharge.

The sludge space plates may be connected to form a unit. The plurality of sludge space plates may be connected to form a unit by a plurality of connecting plates arranged in an axial direction and evenly distributed around the rotational axis. Thus the handling of the sludge space plates may be improved and simplified.

The connecting plates may extend to the rotor wall to support the unit. The centrifugal separator may comprise a distributor supporting the separation plates, and the sludge space plates may be supported by the distributor. Thus the sludge space plates or the unit of discs may efficiently be supported and held in place in the sludge space. The sludge space plates may also be supported by the top disc and/or by the connecting plates coupling to the radially outer portion of the stack of separation plates.

The plurality of separation plates may be a stack of frustoconical discs which may be provided with a number of openings or cut-outs distributed around the periphery of each disc to form passages extending through the stack, preferably in an axial direction. Thus the flow of the fluid mixture to be separated may efficiently be distributed through and over the stack of frustoconical discs.

The rotor may comprise a top disc provided at the top of the separation plates, which top disc extend radially outside the frustoconical plates, and the sludge space plates may extend radially inside an outer portion of the top disc. The centrifugal separator may comprise a third outlet for a denser third component extending from the radially inner portion of the sludge space, such as in a passage between the top disc and the rotor wall. This denser third component of the fluid mixture may be a denser liquid component, such as water.

BRIEF DESCRIPTION OF DRAWINGS

The invention is now described, by way of example, with reference to the accompanying drawings, in which.

DESCRIPTION OF EMBODIMENTS

Figure 1:
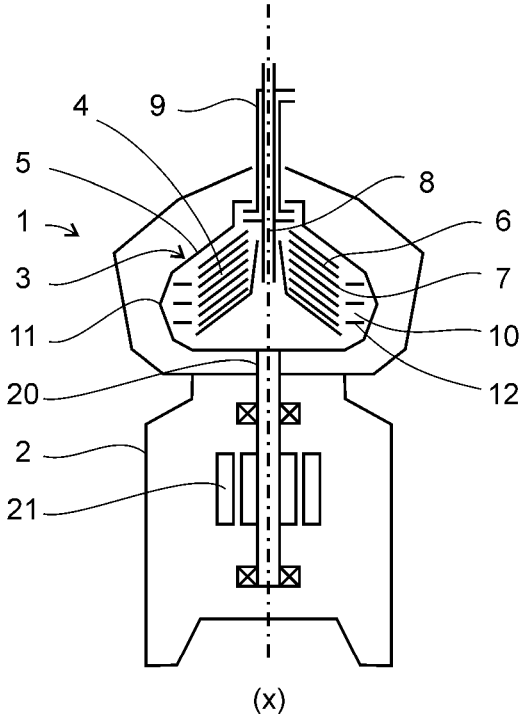
FIG. 1 shows a cross-section of a centrifugal separator having a set of sludge space plates.

FIG. 1 shows a centrifugal separator 1 for separating a fluid mixture into components, such as for separating water and particles from an oil based fluid mixture. The separator has a frame 2 supporting a centrifugal rotor 3 around a rotational axis x by means of a spindle 20 connected to the frame by a first and a second bearing. The rotor is driven by a motor, such as an electric direct drive motor 21 as illustrated. The rotor forms within itself a separation space 4, delimited by a rotor wall 5, wherein a set of separation plates 6 in the form of a stack of frustoconical separation discs is arranged. The separation discs forms separation passages 7 between each pair of adjacent discs. A stationary inlet 8 extends into the rotor for supply of a fluid mixture to be separated to the separation space. A first outlet 9 for a separated lighter first component of the fluid mixture extends from a radially inner portion of the separation space. A sludge space 10 is defined as an annular portion of the separation space radially outside the separation plates, and a second outlet 11 for discharge of a separated denser second component of the fluid mixture extends from the radially outer portion of the sludge space.

The rotor 3 is now further described with reference to FIG. 2. The rotor forms within itself a separation space 4, delimited by a rotor wall 5, wherein a set of separation plates 6 in the form of a stack of frustoconical separation discs is arranged. The separation discs forms separation passages 7 between each pair of adjacent discs. Each separation disc is provided with a number of openings or cut-outs 17 distributed around the periphery of each disc to form passages 18 extending through the stack in an axial direction to distribute the flow of fluid to be separated through and over the disc stack. The rotor further comprises a distributor 16 delimiting a central inlet space 23 in the rotor, which is connected to the separation space 4 via passages in the rotor. The distributor supports the stack of separation discs. A stationary inlet 8 extends into the inlet space for supply of a fluid mixture to be separated. A first outlet 9 for a separated lighter first component of the fluid mixture extends from a radially inner portion of the separation space 4. A sludge space 10 is defined as an annular portion of the separation space radially outside the separation discs. A plurality of second outlets 11 distributed around the circumference of the rotor extend from the radially outer portion of the sludge space for discharge of a separated denser second component of the fluid mixture, denoted sludge. The opening of the second outlets 11 is controlled by an operating slide 24 arranged to be displaced from the closed position in short periods of time for discharge of the sludge collected in the sludge space, as known in the art.

Figure 2:
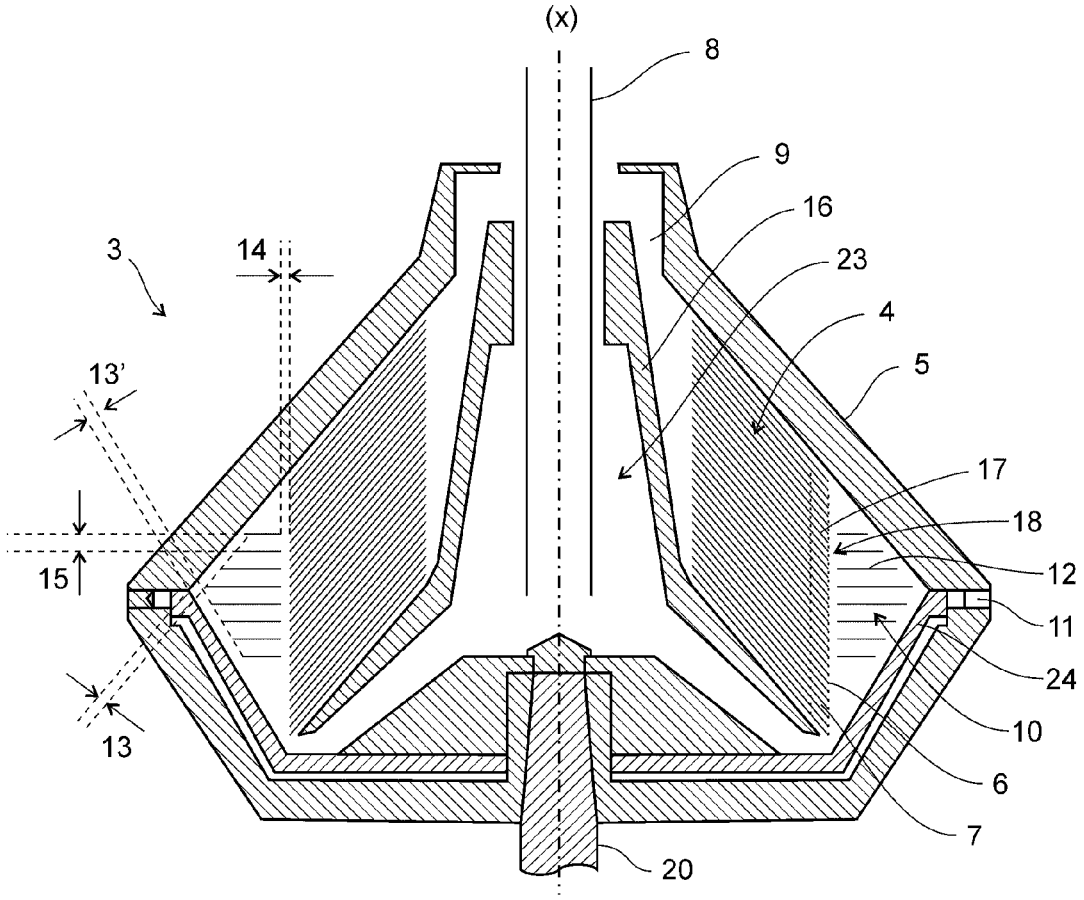
FIG. 2 shows a cross-section of a rotor of a centrifugal separator having a set of sludge space plates.

In the sludge space 10 a plurality of sludge space plates 12 in the form of annular sludge space discs is arranged, enclosing the separation plates and extending perpendicularly outwardly with respect to the rotational axis x, as seen in FIG. 2. The sludge space discs extend in a direction perpendicular to the axial direction. Unlike the separation plates, which are frustoconical, the sludge space discs are planar and extend in only the radial direction. The sludge space discs are separate components from the separation plates. The sludge space discs are configured such that a gap 13, 13' is formed between the sludge space discs and the rotor wall. The gap is provided to enable sludge collected between the sludge space plates to flow towards the second outlets during discharge of sludge. The gap is formed between the sludge space discs and the conical rotor wall since the radial extent of the sludge space discs is varied between the discs to adapt their extent to the conical shape of the rotor wall. The size of the gap may be varied to fit the properties of the sludge to be separated from the fluid, but it should preferably be above 3 mm, and typically 5-10 mm.

The sludge space discs 12 are provided at a mutual distance 15 from one another. In the example shown the distance between the sludge space discs is constant over the stack of sludge space discs. The number of sludge space plates is preferably in the range of 10-20, depending on the size of the rotor. The distance between the sludge space discs is several times larger than the distance between the separation discs forming the separation passages. The distance between the sludge space discs may be varied to fit the properties of the sludge to be separated from the fluid, but it should preferably be in the range of 2-40 mm, more preferably in the range of 5-20 mm, such as of about 10 mm.

The sludge space discs 12 are further arranged such that gap 14 is formed between the separation discs and the sludge space discs. The gap between the separation discs and the sludge space discs is preferably at least 3 mm. Since the separation plates are in the form of frustoconical discs provided with cut-outs in the form of slits to distribute the flow of fluid to be separated through and over the disc stack, which slits are cut-outs that are open towards the outer radius of the separation disc, the gap may be provided to reduce pressure drop over the disc stack. If cut-outs are provided in the form of holes that are closed towards the outer radius of the separation disc the gap between the separation discs and the sludge space discs may be minimised.

Figure 3:
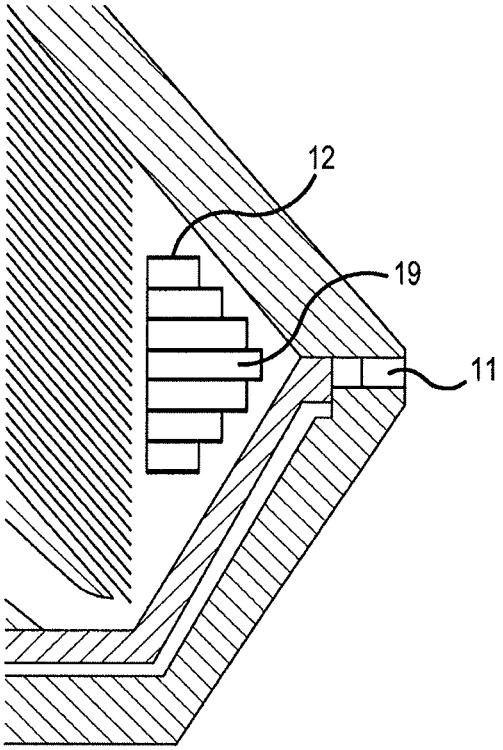

The sludge space plates are connected to form a unit by a plurality of connecting plates 19, as seen in the detailed view of FIG. 3, arranged in an axial direction and evenly distributed around the rotational axis. Typically the connecting plates are arranged in a plane including the rotational axis x and extend from a radially inner position outside the separation discs to a radially outer position in the region of the rotor wall, thus extending in a radial direction whereby the sludge space plates 12 are disposed perpendicular to the connecting plates 19. Thus the connecting plates divide the annular sludge space into sectors of similar size, acting to minimise flow and turbulence in the tangential direction in the sludge space. The connecting plates may extend to the rotor wall, at least to form contact points to support the unit. The connecting plates may further be configured such that to provide a gap 13/13' between the connecting plates and the rotor wall, and wherein the gap between the connecting plates and the rotor wall preferably is at least 3 mm. Thus sludge collected between the sludge space plates may more easily flow towards the second outlets during discharge of sludge and to facilitate cleaning of the sludge space. The unit of sludge space plates and connecting plates may be supported by the connecting plates coupling to the radially outer portion of the stack of separation discs 6 and/or by the radially outer portion of the distributor 16.

During operation, the rotor 3 is rotated at an operational speed, a fluid mixture to be separated into components is introduced into the inlet space 23 of the rotor by the inlet 8. The fluid is transported to the separation space via passages in the rotor, by means of centrifugal forces. The flow of fluid is then distributed over the stack of separation discs 6 via the axial passages 18 provided by the cut-outs 17 in the discs, and into the separation passages 7 between adjacent separation discs. In the separation passages denser and lighter components of the fluid mixture are separated. Lighter components of the fluid (e.g. oil) are transported radially inwardly towards the first outlet 9 for a separated lighter first component of the fluid mixture, which first outlet extends from a radially inner portion of the separation space. From the first outlet chamber fluid may be peeled by a peeling device as known in the art. Denser components of the fluid (such as water and solid particulate matter, i.e. sludge) are transported radially outwardly in the separation space towards the sludge space 10. The denser components pass between the sludge space plates and collect at the radially outer portion of the sludge space, inside the second outlets 11.

The sludge space discs arranged in the sludge space tend to reduce currents, turbulence or flow in directions along the rotational axis of the sludge space. Such currents having an axial flow component may have the undesired effect to bring along particles already separated from a liquid mixture of components. Thereby the risk of particles (solid and/or fluid) separated in the separation passages being brought along by such flow and reintroduced in another separation passage is reduced. The sludge space discs thus tend to increase the separation efficiency of the separator.

To empty the sludge space from sludge, discharge is initiated by displacing the operating slide 24 to open the second outlets 11. Sludge collected in the sludge space is then discharged through the second outlets by means of centrifugal force. Sludge collected in the passages between adjacent sludge space plates is displaced outwardly, into the gap 13/13' between the sludge space plates and the rotor wall and out through the second outlets. The outlets are then closed by moving the operating slide to the closed position.

In an embodiment not shown the centrifugal separator as previously described further comprises a third outlet for a third component, denser than the first component, extending from the radially inner portion of the sludge space. This denser third component of the fluid mixture may be a denser liquid component, such as water. A top disc is provided at the upper end of the stack of separation discs. The top disc delimits a passage between the top disc and the rotor wall for a denser third component separated from the fluid mixture extending from the radially inner portion of the sludge space, connected to the third outlet. The top disc is configured to extend radially outside the frustoconical plates, and the sludge space plates extend radially inside an outer portion of the top disc. In this embodiment the unit of sludge space plates and connecting plates may be supported by the top disc. Among the denser components separated from the fluid mixture, the least dense components, such as water, flow over the radially outer edge of the top disc towards the third outlet. From third outlet chamber fluid may be peeled by a peeling device as known in the art.

The invention claimed is:

1. A centrifugal separator for separating a fluid mixture into components, comprising:

a frame;

a rotor which is rotatably supported in the frame around a rotational axis, which rotor forms within itself a separation space delimited by a rotor wall, and comprising a set of separation plates defining separation passages there between;

an inlet extending into the rotor for supply of a fluid mixture to be separated in the separation space;

a first outlet for a separated lighter first component of the fluid mixture extending from a radially inner portion of the separation space;

a sludge space being defined as an annular portion of the separation space radially outside the separation plates;

a second outlet for a separated denser second component of the fluid mixture extending from the radially outer portion of the sludge space; and a plurality of sludge space plates arranged in the sludge space and connected by connecting plates arranged in an axial direction, an inner edge of the sludge space plates being radially spaced from an outer edge of the separation plates, the sludge space plates extending perpendicular to the rotational axis and disposed perpendicular to the connecting plates, wherein the plurality of sludge space plates are spaced from one another in an axial direction with respect to the rotational axis, wherein the sludge space plates are separate components from the separation plates, and wherein a gap is formed between the sludge space plates and the rotor wall.

2. The centrifugal separator according to claim 1, wherein the sludge space plates are in the form of spaced annular discs enclosing the separation plates.

3. The centrifugal separator according to claim 1, wherein the radial extent of the sludge space plates is varied to provide the gap between the sludge space plates and the rotor wall, and wherein the gap between the sludge space plates and the rotor wall is at least 3 mm.

4. The centrifugal separator according to claim 1, wherein the space between the outer edge of the separation plates and the inner edge of the sludge space plates is at least 3 mm.

5. The centrifugal separator according to claim 1, wherein the sludge space plates are arranged at a mutual distance which is larger than the distance between the separation plates defining separation passages there between, which mutual distance of the sludge space plates is in the range of 2-40 mm.

6. The centrifugal separator according to claim 1, wherein the number of sludge space plates is in the range of 5-30.

7. The centrifugal separator according to claim 1, wherein the sludge space plates are connected to form a unit by said connecting plates.

8. The centrifugal separator according to claim 1, wherein the plurality of separation plates is a stack of frustoconical discs.

9. The centrifugal separator according to claim 8, wherein the frustoconical discs are provided with a number of openings distributed around the periphery of each disc to form passages extending through the stack.

10. The centrifugal separator according to claim 1, wherein the sludge space plates are arranged at a mutual distance which is larger than the distance between the separation plates defining separation passages there between, which mutual distance of the sludge space plates is in the range of 5-20 mm.

11. The centrifugal separator according to claim 1, wherein the sludge space plates are arranged at a mutual distance which is larger than the distance between the separation plates defining separation passages there between, which mutual distance of the sludge space plates is about 10 mm.

12. The centrifugal separator according to claim 1, wherein the number of sludge space plates is in the range of 10-20.

13. A centrifugal separator for separating a fluid mixture into components, comprising:

a frame;

a rotor which is rotatably supported in the frame around a rotational axis, which rotor forms within itself a separation space delimited by a rotor wall, and comprising a set of separation plates defining separation passages there between;

an inlet extending into the rotor for supply of a fluid mixture to be separated in the separation space;

a first outlet for a separated lighter first component of the fluid mixture extending from a radially inner portion of the separation space;

a sludge space being defined as an annular portion of the separation space radially outside the separation plates;

a second outlet for a separated denser second component of the fluid mixture extending from the radially outer portion of the sludge space; and a plurality of sludge space plates arranged in the sludge space and connected by connecting plates arranged in an axial direction, an inner edge of the sludge space plates being radially spaced from an outer edge of the separation plates, the sludge space plates being planar and disposed perpendicular to the connecting plates, wherein the plurality of sludge space plates are spaced from one another in an axial direction with respect to the rotational axis, wherein the sludge space plates are separate components from the separation plates, and wherein a gap is formed between the sludge space plates and the rotor wall.

* * * * *